US009968969B2

(12) United States Patent
Brigham et al.

(10) Patent No.: US 9,968,969 B2
(45) Date of Patent: May 15, 2018

(54) METHOD AND MECHANISM TO AUTOMATE MAIL SWEEPING

(71) Applicant: Toshiba International Corporation, Houston, TX (US)

(72) Inventors: Michael Edward Brigham, Colleyville, TX (US); Jeffrey Anthony Gavenas, Grapevine, TX (US)

(73) Assignee: Toshiba International Corporation, Houston, TX (US)

( * ) Notice: Subject to any disclaimer, the term of this patent is extended or adjusted under 35 U.S.C. 154(b) by 48 days.

(21) Appl. No.: 14/755,382

(22) Filed: Jun. 30, 2015

(65) Prior Publication Data

US 2016/0001911 A1 Jan. 7, 2016

Related U.S. Application Data

(60) Provisional application No. 62/020,112, filed on Jul. 2, 2014.

(51) Int. Cl.
*B07C 7/02* (2006.01)
*B07C 3/08* (2006.01)
*B07C 7/04* (2006.01)

(52) U.S. Cl.
CPC ..... *B07C 3/087* (2013.01); *B07C 7/02* (2013.01); *B07C 7/04* (2013.01)

(58) Field of Classification Search
CPC .. B07C 3/02; B07C 3/087; B07C 7/02; B07C 7/04
USPC ..... 209/630; 211/12, 134
See application file for complete search history.

(56) References Cited

U.S. PATENT DOCUMENTS 4,488,610 A * 12/1984 Yankloski ..... B07C 3/04 101/2
5,050,743 A * 9/1991 Lazzarotti ..... B07C 7/02 211/12
5,061,233 A * 10/1991 Schultz ..... B65H 45/1015 414/798.2
5,233,814 A * 8/1993 Bergerioux ..... B07C 1/025 53/241
5,284,336 A * 2/1994 Ricciardi ..... B65H 31/06 271/213
5,590,794 A * 1/1997 Zachary ..... B07C 7/02 209/702
6,435,353 B2 * 8/2002 Ryan, Jr. ..... B07C 1/025 209/706
6,610,954 B2 * 8/2003 Takizawa ..... B07C 7/005 198/349

(Continued)

*Primary Examiner* — Joseph C Rodriguez
(74) *Attorney, Agent, or Firm* — Baker Botts L.L.P.

(57) ABSTRACT

Presently disclosed embodiments are directed to a process and mechanism for reducing human error and manual labor used to sweep pockets on a mail sorting machine. Specifically, the disclosed embodiments utilize a sliding drawer holding a receiving container that can mate in a flush arrangement with an output pocket of a mail sorting machine. Thus, sweeping of mail product from the output pocket to the receiving container can be accomplished in one motion that empties the entire output pocket into the receiving container. This sweeping may be performed by an operator without any errors caused by sweeping to an incorrect receiving container or issues caused by dropping sorted mail product and picking it back up in a different order.

18 Claims, 6 Drawing Sheets

(56) References Cited

U.S. PATENT DOCUMENTS 7,014,030 B2 * 3/2006 Hendzel ..... F16M 1/00 193/2 R
7,080,739 B2 * 7/2006 Guy ..... B07C 3/008 198/369.1
7,112,031 B2 * 9/2006 Harres ..... B07C 3/008 209/509
7,140,498 B2 * 11/2006 Pippin ..... B07C 3/00 211/12
7,304,260 B2 * 12/2007 Boller ..... B07C 3/008 198/370.02
7,527,154 B2 * 5/2009 Kara ..... B07C 3/008 209/630
7,540,385 B2 * 6/2009 Enenkel ..... B07C 3/008 209/584
7,553,119 B2 * 6/2009 Good ..... B07C 1/00 271/2
7,600,751 B2 * 10/2009 Rozenfeld ..... B65H 29/60 271/214
7,866,936 B2 * 1/2011 Schuck ..... B65G 65/00 271/213
7,959,013 B2 * 6/2011 Chifflet ..... B07C 3/00 209/630
8,025,155 B2 * 9/2011 Pippin ..... B07C 7/00 209/630
8,393,475 B2 * 3/2013 Hugues ..... B07C 7/02 209/630
8,552,327 B2 * 10/2013 Pippin ..... B07C 3/00 209/583
8,863,961 B2 * 10/2014 Carpenter ..... B07C 3/00 209/546
9,167,913 B2 * 10/2015 Hardy ..... A47F 1/12
2003/0006174 A1 * 1/2003 Harres ..... B07C 3/008 209/584
2003/0108416 A1 * 6/2003 Schererz ..... B65B 43/54 414/794.4
2003/0141226 A1 * 7/2003 Morikawa ..... B07C 5/18 209/584
2009/0272859 A1 * 11/2009 Pippin ..... B07C 7/00 248/99
2011/0211939 A1 * 9/2011 Hugues ..... B07C 7/02 414/789.9

* cited by examiner

METHOD AND MECHANISM TO AUTOMATE MAIL SWEEPING

CROSS REFERENCE TO RELATED APPLICATIONS

This application is a non-provisional of U.S. Provisional Application Ser. No. 62/020,112, entitled "A Method and Mechanism to Automate Mail Sweeping," filed Jul. 2, 2014, which is herein incorporated by reference.

TECHNICAL FIELD

Embodiments of the present disclosure relate to mail handling and processing systems for mail and related articles and, more particularly, to systems and methods for transporting articles of mail from sortation output pockets into a receiving container designed for the purpose of moving items to a feed mechanism or to dispatch and shipping.

BACKGROUND

Mail received at a post office or other location is sorted or otherwise processed so that it can be directed to a desired location. To accomplish this function, sortation machines with output pockets are used to sort various mail product. Typically, the product that arrives in the output pockets of a sortation machine is removed manually and placed in movable containers, trays, or other containing devices so that it can be moved through additional sortation processes or dispatched to arrive at its intended destination. As an example, letters sorted on a Delivery Bar Code Sorter (DBCS) arrive in letter trays. An operator manually moves the letters from the trays onto a feeder load ledge to begin the sort process. Once sorted to the sorter pockets of the DBCS, an operator removes the letters from the output pockets, a handful at a time, and places them in a labeled letter tray so they can be transported to the next processing step. In addition to being manually intensive, this process is prone to operator error. For example, an operator may accidently drop a handful of mail or place the mail in the wrong tray, thereby losing an intended order of the mail or sending it to the wrong location. A portable bridge is sometimes used to bridge the distance between individual output pockets and corresponding trays, but this type of bridge is cumbersome and takes time to transport from one set of output pockets/trays to another.

Therefore, it is now recognized that a need exists for an efficient and simple to operate mechanism that would eliminate the errors that naturally occur through operators manually removing items from sorter output pockets and placing those items in containing devices for processing or delivery.

SUMMARY

In accordance with the above, presently disclosed embodiments are directed to a set of moveable drawers that map one to one with the output pockets of a sorter, thereby reducing or eliminating the possibility of an operator placing the contents of the output pocket into an incorrect receiving container. These drawers, when extended, come into close proximity with a floor of the sorter pocket so that no gap (or only a very small gap) is present between the output pocket and drawer. The receiving container resides in the drawer and is positioned to receive the contents of the output pocket when the drawer is extended to the open position. From this position, the entire contents of the output pocket may be moved into the receiving container with one physical movement of sliding the contents from the pocket to the container. Thus, an operator does not have to physically pick up the items a handful at a time. This operation may be performed when the sorter output pocket is full as indicated by the sorter, thus reducing the number of times the operator has to perform the sweeping operation. Once the receiving container is filled, the drawer may be slid into the closed position and the operator may depress a "container full" button. This may prompt the system to move the full receiving container to a different location and deposit an empty receiving container into the corresponding drawer so that the process can be repeated.

DETAILED DESCRIPTION

Figure 1:
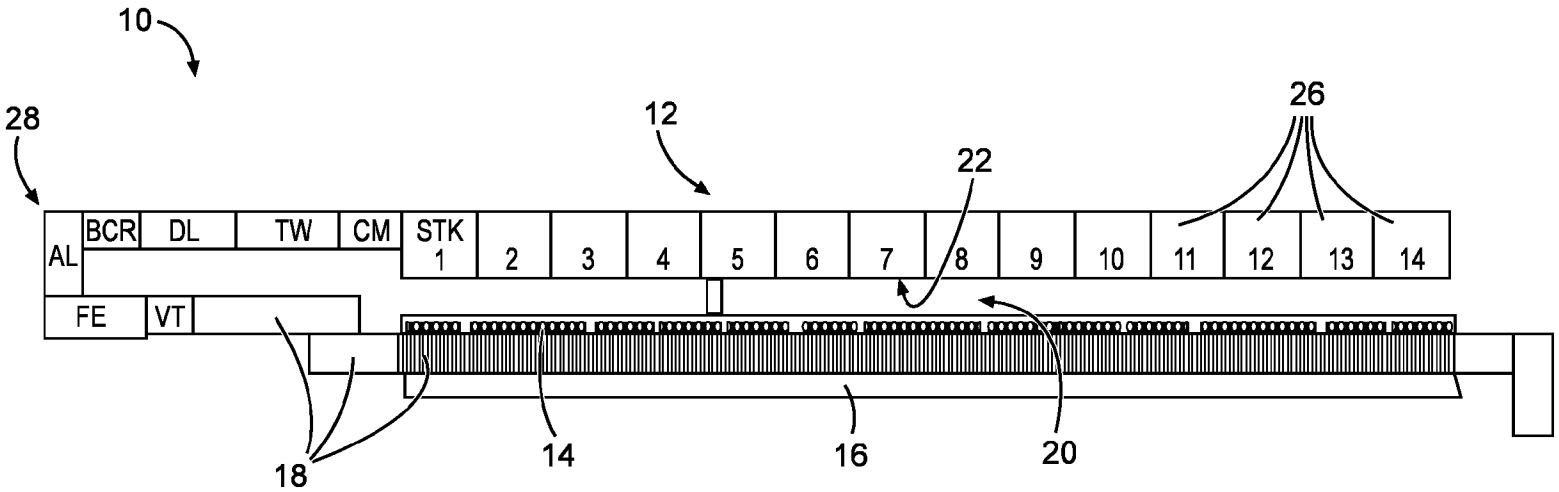
FIG. 1 is a schematic top view of a mail sortation and transportation system, in accordance with an embodiment of the present disclosure.

Turning now to the drawings, FIG. 1 illustrates a mail sortation and transportation system 10 used to sort mail product and deliver the product to a desired destination. As shown, the mail sortation and transportation system 10 may include a sorter 12, a drawer system 14, a tray storage and movement system 16, and a tray to feeder path 18. The illustrated drawer system 14 is oriented substantially parallel to the sorter 12, and between the sorter 12 and the drawer system 14 is an aisle space 20 wide enough to accommodate a human operator.

The sorter 12 may be a Delivery Bar Code Sorter (DBCS) in some embodiments. The sorter 12 may receive mail product and sort the mail according to bar codes that indicate where the mail should be delivered. The sorter 12 then stores the sorted mail in output pockets. These output pockets may be arranged in columns and/or rows to form a wall 22 of output pockets adjacent the aisle space 20.

The drawer system 14 includes rows and columns of drawers 24 that are mounted in a storage rack. These drawers 24 may each hold a receiving container used to collect sorted mail. The drawers 24 are designed to be extended from the drawer system 14 toward the sorter output pockets. Each drawer 24 is located across the aisle space 20 from a corresponding one of the output pockets. As illustrated, one or more of the drawers 24 may be extended from the drawer system 14 into close proximity with a corresponding sorter output pocket. In some embodiments, the drawer 24 may be extended into a flush engagement with the output pocket, while in other embodiments the drawer 24 may be extended to a position leaving a gap between the drawer 24 and the output pocket of the sorter 12 but positioned such that mail can be swept from the output pocket to the drawer 24. From this position, an operator can easily transfer mail product from the output pocket to the correct receiving container, as described in detail below.

It should be noted that the disclosed drawer system 14 may be configurable for use with a variety of different types of sorters 12. For example, the drawer system 14 may be configured for use with a sorter 12 that has 48, 206, or any other desirable number of output pockets. The sorter 12 may include these output pockets assembled in one, two, three, four, five, six, or more tiers stacked one over the other, depending on the height of the individual pockets and the height an operator is expected to reach to perform a sweeping operation. The drawer system 14 may be designed to match the configuration of the sorter 12 with which the drawer system 14 will be used, having the same number and configuration of drawers 24 as the sorter has output pockets. In other embodiments, the drawer system 14 may be adjustable to match the particular sorter configuration by adding or subtracting modules 26 of the drawer system.

In general, the output pockets of a given sorter 12 are standardized, so that they are approximately the same size and shape for uniform mail collection and sweeping. Similarly, the drawer system 14 may include standardized sizes of drawers 24 that match the corresponding output pockets. In other embodiments, the drawer system 14 may include drawers 24 that are configurable to match any desirable size of sorter output pockets.

The tray storage and movement system 16 is disposed adjacent the drawer system 14 and may be used to store receiving containers. For example, the tray storage and movement system 16 may include racks upon which to store receiving containers that have been filled with mail product from the drawer system 14 or empty receiving containers to be provided to the drawer system 14.

The tray storage and movement system 16 may include a storage rack having more slots for holding receiving containers than the number of drawers 24 in the drawer system 14, thus enabling the tray storage and movement system 16 to store the filled or empty receiving containers away from the drawers 24.

In some embodiments, the receiving containers may be transported between the tray storage and movement system 16 and the drawer system 14 manually by an operator. In other embodiments, however, the tray storage and movement system 16 may be designed to automatically move a filled receiving container from a given drawer 24 and to replace it with an empty receiving container. To that end, the tray storage and movement system 16 may utilize roller conveyors, elevators, robots, and other types of automated transportation devices. The tray storage and movement system 16 may be fully automated to read tagged receiving containers and to use that information to present filled receiving containers in a desired order for a second pass through the sorter 12 or for dispatch.

The tray to feeder path 18 is a conveyor that moves receiving containers filled with mail product to an upstream location (e.g., feeder) 28 of the sorter 12. From this upstream location 28 of the sorter 12, the mail product is sorted into the output pockets of the sorter 12. The tray to feeder path 18 may provide receiving containers holding new unsorted mail to the sorter. In some embodiments, the tray to feeder path 18 may also provide receiving containers holding mail that has already been sorted by the sorter 12 and subsequently swept into the drawer system 14 and tray storage and movement system 16. In this case, the tray to feeder path 18 may be controlled to transport the sorted mail back to the upstream location 28 of the sorter 12 so that the sorter 12 can perform a second pass on sorting the mail product, or to transport the sorted mail to a dispatch location. As illustrated, the tray to feeder path 18 may be elevated above the drawer system 14 so that the tray storage and movement system 16 is able to automatically move filled receiving containers of mail from the drawer system 14 onto the tray to feeder path 18.

Figure 2:
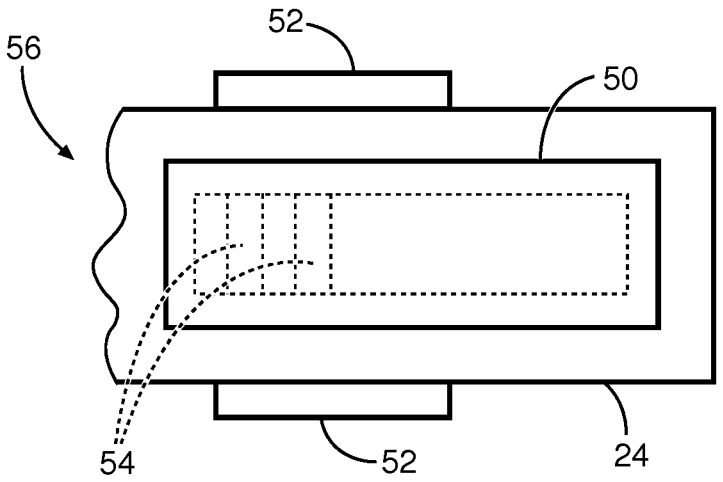
FIG. 2 is a schematic top view of a drawer holding a receiving container, in accordance with an embodiment of the present disclosure.

FIG. 2 is a more detailed view of the drawer 24 holding a receiving container 50. The drawer 24 may include a slide mechanism 52 for moving the drawer 24 in and out of the drawer system. The extension of the drawer 24 on such slide mechanisms 52 allows the drawer 24 to be manually extended across the aisle and into contact or close proximity with a corresponding output pocket of the sorter such that mail can be swept into the container 50 in the drawer 24.

The rack of the drawer system may include a pair of rails or other feature upon which the slide mechanisms 52 of the drawer 24 can slide as the drawer 24 is opened and closed.

As illustrated, the drawer 24 may hold the receiving container 50 designed to receive and hold mail product that comes off the sorter. Specifically, the receiving container 50 is disposed in the drawer 24 so that mail product exiting the corresponding sorter output pocket can be placed into the receiving container 50 for easy transportation to a particular destination. The drawers 24 are part of the drawer system, but the receiving containers 50 can be placed into and removed from the drawers 24 as desired. Thus, the drawer 24 facilitates a movement of the sorted mail product from the output pocket to the receiving container 50 without the drawer 24 being permanently affixed to the output pocket or to the receiving container 50.

Figure 3:
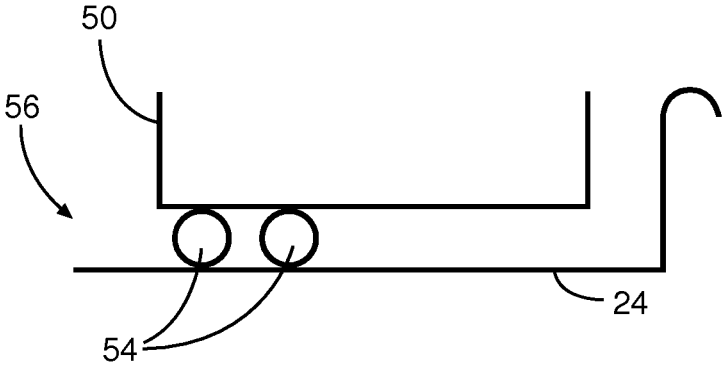
FIG. 3 is a schematic side view of the drawer holding the receiving container of FIG. 2, in accordance with an embodiment of the present disclosure.

To facilitate placement and removal of the receiving containers 50, the drawers 24 may be equipped with rollers 54, as illustrated in FIG. 2 and FIG. 3. This allows the receiving container 50 to be rolled into and out of the drawer 24 from a back side 56 (not facing the sorter) of the drawer 24, as illustrated by arrows in FIG. 6. This access allows other automated or manual operations to either insert or remove a receiving container 50 through the back side 56 of the drawer 24. It should be noted that, when the drawer 24 is in an open position, the same access may be allowed from the front of the drawer system so that receiving containers 50 can be inserted or removed from the drawer 24.

The drawer system may be adapted for use with different types of receiving containers 50. For example, the drawers 24 are designed to hold standardized receiving containers 50 that are currently in use with various postal services. In addition, the drawer system may be used with new types of receiving containers 50, such as the automated bin 70 illustrated in FIG. 4. The automated bin 70 is a receiving container 50 sized similar to the receiving containers 50 of FIGS. 2 and 3, but having an adjustable floor portion 72 that may be selectively actuated from a flat horizontal plane to a tilted plane. When in the tilted position (as shown), the adjustable floor 72 may more easily accommodate the mail product being swept into the receiving container 50. In some embodiments, the receiving container 50 may be designed to interact with the drawer such that the drawer opening triggers the adjustable floor 72 of the receiving container 50 to tilt upward by a certain degree. Subsequently, as the drawer is closed the trigger may be automatically released to lower the floor 72 back to a plane that is horizontal with respect to the drawer.

Figure 5:
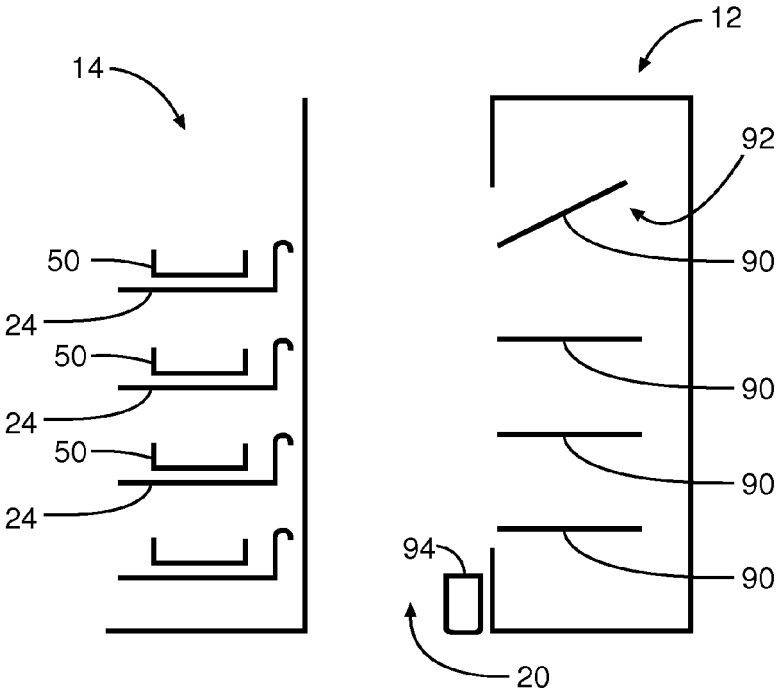
FIG. 5 is a schematic side view of a series of drawers and a corresponding section of a Delivery Bar Code Sorter (DBCS), with the drawers in a closed position, in accordance with an embodiment of the present disclosure.

FIG. 5 illustrates an embodiment of the sorter 12 (e.g., DBCS) and the drawer system 14 with all the drawers 24 in the closed position. Again, the sorter 12 and drawer system 14 are arranged on either side of an aisle space 20 wide enough to accommodate a person between the drawer system 14 and the sorter 12. The drawers 24 are arranged such that there is a one to one mapping across the aisle 20 with the corresponding output pockets 90 of the sorter 12. This enables a more accurate and efficient sweeping operation than would be available using a portable bridge placed between one set of pockets/receiving containers at a time.

As illustrated, certain rows 92 of the output pockets 90, such as the upper one or two rows, may be tilted relative to a horizontal plane. This may enable an operator to more easily reach and sweep the main product from these output pockets 90 into the corresponding drawer 24. At times, an operator may use a stepping stool 94 to reach these upper output pockets 92 of the sorter 12.

Figure 6:
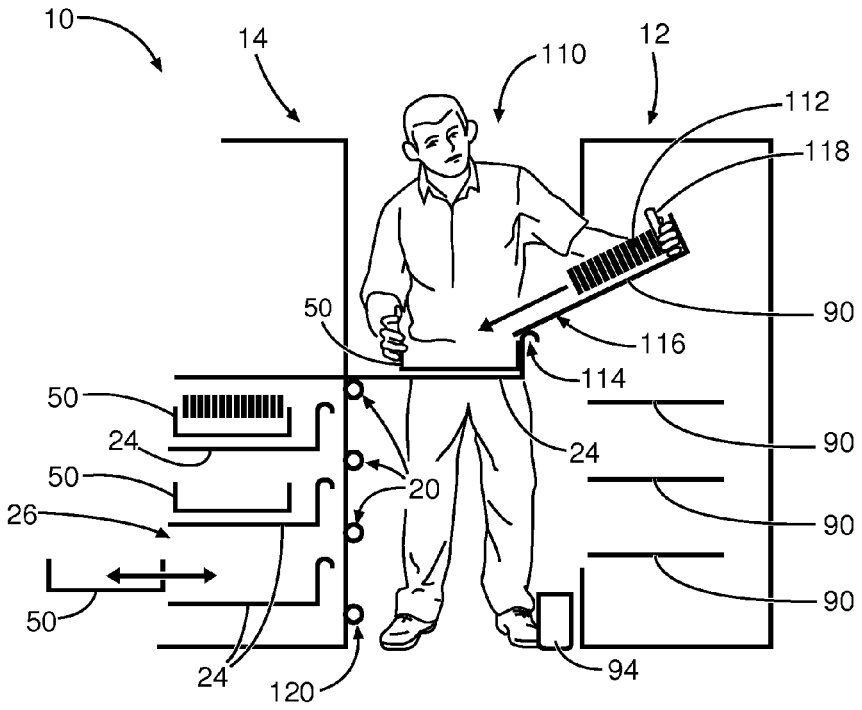
FIG. 6 is a schematic side view of an operator placing mail from the DBCS of FIG. 5 into an open drawer, in accordance with an embodiment of the present disclosure.

FIG. 6 illustrates an operator 110 using the drawer system 14 of FIG. 5 to sweep sorted mail 112 from one of the sorter output pockets 90 to the appropriate receiving container 50 in an extended drawer 24. The drawer 24 may be opened manually by the operator 110 or automatically by the drawer system 14 in response to the operator 110 pressing a button. When the drawer 24 is opened, as shown, a leading edge of a handle 114 of the drawer 24 may come into direct contact with a lower edge 116 of the output pocket 90. In some embodiments, the drawer 24 may be extended into close proximity with the output pocket 90 such that the mail cannot fall through a gap between the output pocket 90 and the extended drawer 24 when the mail is swept from one to the other. To that end, the drawer 24 may be extended such that any gap between the extended drawer 24 and the output pocket 90 is less than approximately one inch.

Figure 7:
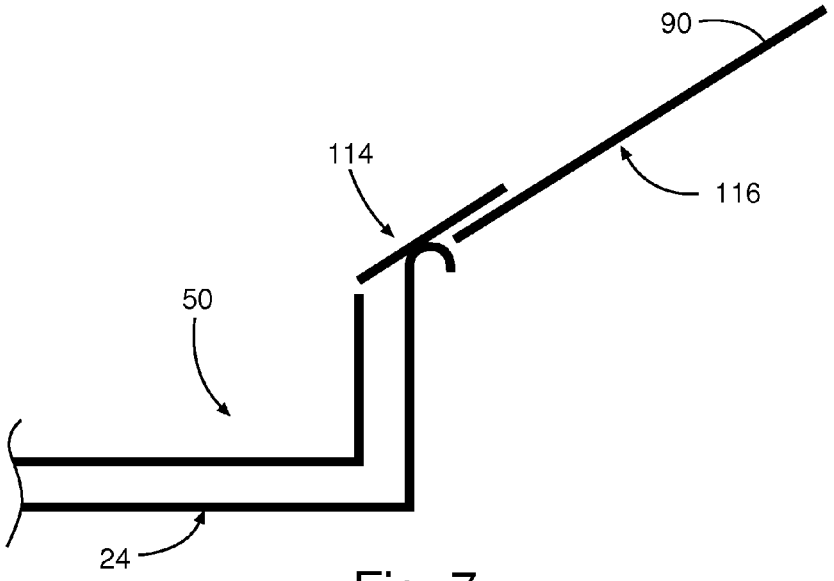
FIG. 7 is a schematic side view of the open drawer mapping to a corresponding output pocket of the DBCS of FIG. 6, in accordance with an embodiment of the present disclosure.

As shown in FIG. 7, the handle 114 of the drawer 24 may be customized for each application to allow for a smooth transition from the edge of the output pocket 90 to the receiving container 50 being used. For example, the drawer 24 may feature a customizable handle 114 with an edge that can be brought into alignment with the output pocket 90, as shown, while also interfacing with the receiving container 50. In other embodiments, the receiving container 50 may feature an edge designed to extend out over the handle 114 of the drawer 24 to interface more directly with the corresponding output pocket 90. The receiving container 50 may be held in place by the drawer 24 to provide a smooth transition of the mail. Once in this position, the contents of the output pocket 90 can be easily slid down or over into the receiving container 50. For example, as shown in FIG. 6, the smooth transition between the receiving container 50 and the output pocket 90 allows the operator 110 to sweep the mail from an entirely filled output pocket 90 into the receiving container 50 using a single sweeping motion. The operator 110 may utilize one or more paddles 118 to sweep the mail from the output pocket 90 into the appropriate receiving container 50. Additional paddles 118 may be used to shield the sorter 12 from feeding additional sorted mail into the output pocket 90 during the sweeping operation.

Upon completion of the sweeping operation, the drawer 24 is pushed back into its closed position. The operator 110 may then push a "full container" button 120 next to the particular drawer 24, in order to alert the rest of the mail sortation and transportation system 10 that a full receiving container 50 is available. In response to receiving the "full container" indication, the tray storage and movement system may remove the full receiving container 50 from the back 56 of the drawer 24, transport the full receiving container 50 to another location for storage or further processing, and place an empty receiving container 50 into the drawer 24 so the process can be repeated. As noted above, these tasks of removing and replacing the receiving container 50 may be automated or performed manually by an operator.

Figure 8:
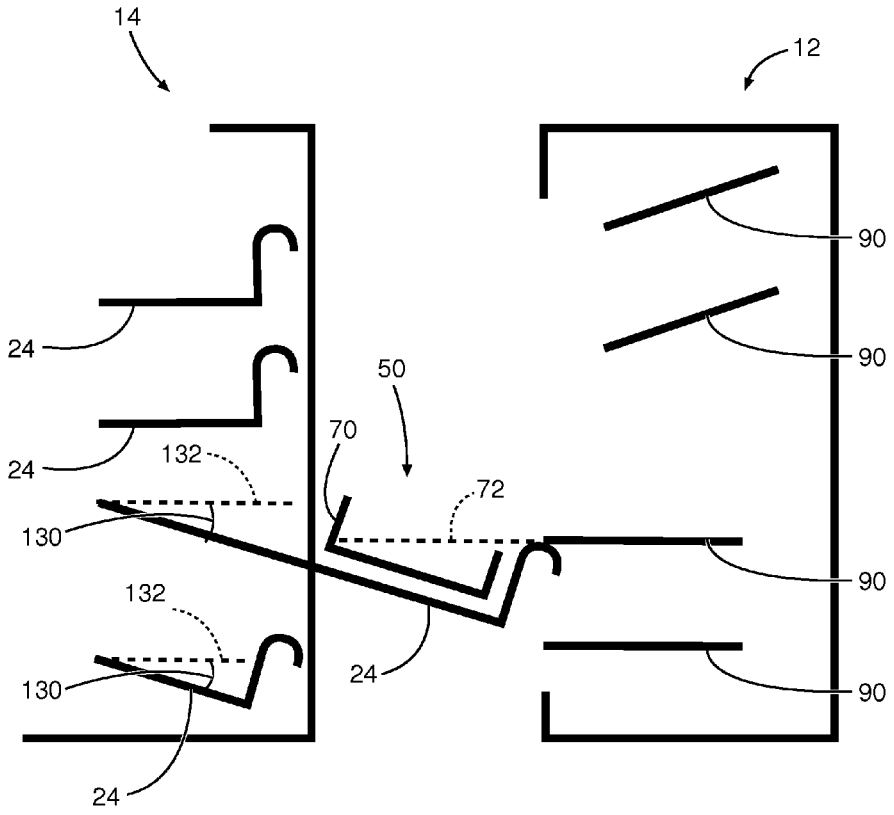
FIG. 8 is a schematic side view of an open drawer that is angled to allow sweeping of mail from a DBCS to the receiving container of FIG. 4, in accordance with an embodiment of the present disclosure.

FIG. 8 illustrates another embodiment of the drawer system 14 that may be used in conjunction with the sorter 12. In this embodiment, the drawers 24 each map one to one with a corresponding output pocket 90. However, one or more of the drawers 24 may extend outward from the rack at an angle 130 relative to the horizontal plane 132, in order to bring the receiving containers 50 (bin 70) described above in reference to FIG. 4 toward the corresponding output pocket 90. As noted above, these receiving container bins 70 may include a floor 72 that tilts in response to the drawer 24 being extended out from the drawer system 14. In the illustrated embodiment of FIG. 8, the two tilted drawers 24 may be angled such that the tilted floor 72 of each of the receiving containers 50 comes into alignment with the corresponding output pocket 90 when the drawers 24 are extended outward. This may enable a relatively smooth transition of mail from the output pocket 90 to the elevated floor 72 of the receiving container bin 70 during sweeping operations.

Figure 4:
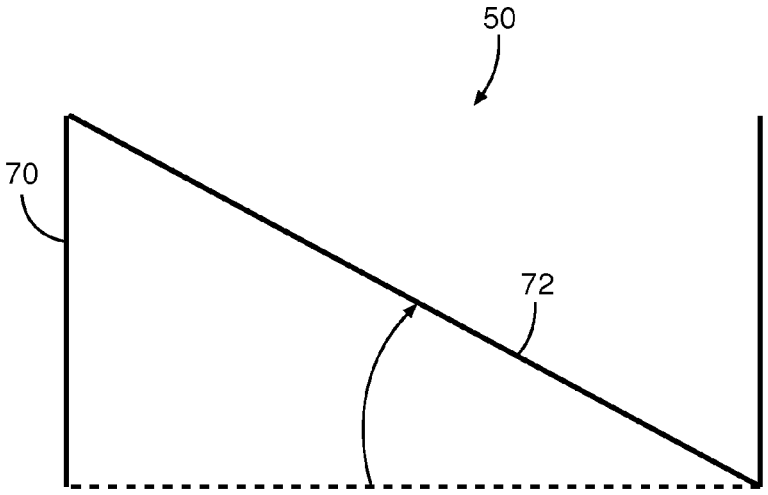
FIG. 4 is a schematic view of a receiving container that may be held in the drawer of FIG. 2, in accordance with an embodiment of the present disclosure.

Although FIG. 8 illustrates one method for presenting the receiving container bin 70 of FIG. 4 in alignment with the corresponding output pocket 90, other techniques may be used. For example, it may be desirable that the drawers 24, when in the closed position, be level with a horizontal plane 132 so that the receiving container 50 disposed thereon remains level. This enables relatively easy extraction of the receiving container 50 from the drawer 24 and may prevent the mail from sliding around in the receiving container 50 when the receiving container 50 is not full. In addition, keeping the drawer 24 level and square with the enclosing rack (i.e., drawer system 14) when in the closed position allows efficient stacking of drawers 24 in racks or arrays.

Figure 9A:
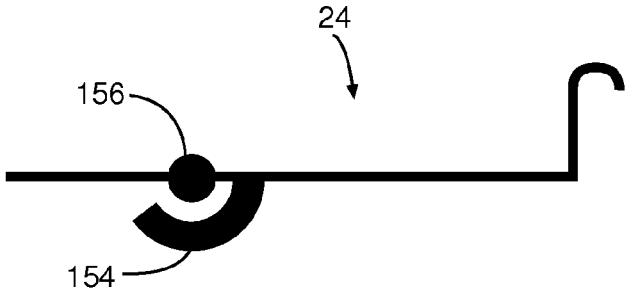
FIGS. 9A-9C are schematic views of a drawer that can be angled to allow sweeping of mail from a sorter to the receiving container of FIG. 4, in accordance with an embodiment of the present disclosure
Figure 9B:
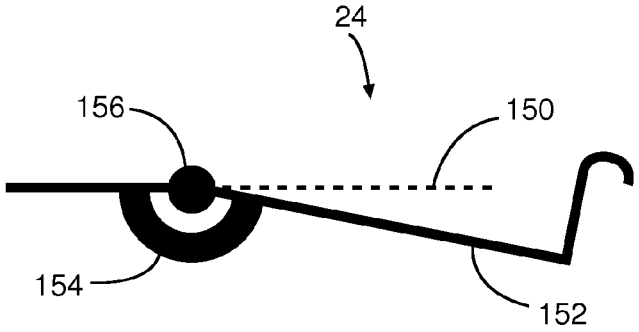
Figure 9C:
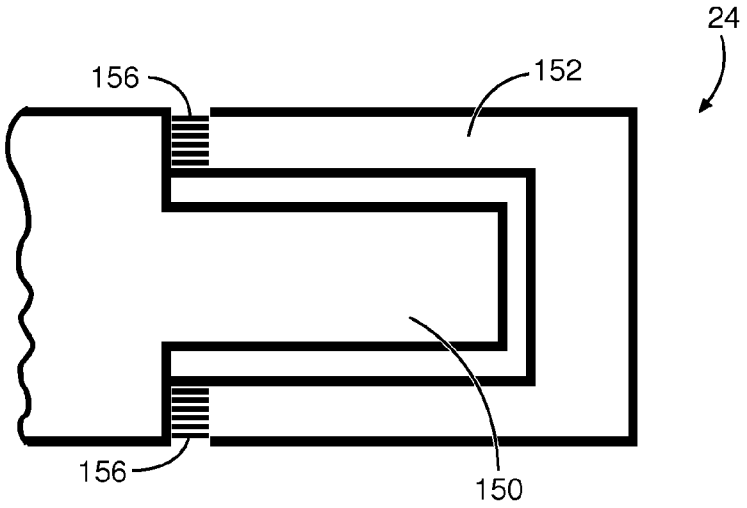

FIGS. 9A-9C illustrate an embodiment of a drawer that can remain level with respect to a horizontal plane when in the closed position and is able to accommodate the receiving container bin having an adjustable floor as described above. The illustrated drawer 24 is able to drop down, when opened, with a mechanism to allow the adjustable floor of the receiving bin to be brought substantially into alignment with the output pocket to allow efficient sweeping of the mail from the output pocket to the receiving bin.

FIG. 9A illustrates the drawer 24 in a closed position. As mentioned above, in this position the drawer 24 when closed is level and square to the retaining rack. As illustrated in FIGS. 9B and 9C, the drawer 24 may include a stationary floor portion 150 that remains level and square to the retaining rack regardless of whether the drawer 24 is open or closed. In addition, the drawer 24 may include a moveable portion 152 that can drop down relative to the stationary floor portion 150. This moveable portion 152 of the drawer 24 may be positioned underneath the sides of the receiving bin disposed in the drawer 24. The stationary portion 150 of the drawer 24 is disposed beneath the adjustable floor (e.g., 72 of FIG. 4) of the receiving bin (e.g., 70 of FIG. 4).

When the drawer 24 is opened, as illustrated in FIG. 9B, the stationary floor 150 remains level even as it moves in and out of the rack along with the rest of the drawer 24. However, the moveable portion 152 of the drawer 24 can drop down until it reaches a limit of a built in stop 154. In the illustrated embodiment, for example, the moveable portion 152 rotates about a hinge 156 until it touches a stop mechanism 154 configured to stop the moveable portion 152 at a desired position. As the moveable portion 152 drops, the side walls of the receiving bin may drop as well. This allows the stationary floor 150 of the drawer 24 to effectively push up the internal adjustable floor of the receiving bin by letting down the side walls of the receiving container. In this manner, the drawer illustrated in FIGS. 9A-9C may bring the adjustable floor 72 of the receiving bin 70 of FIG. 4 to a position proximate and level with the corresponding output pocket 90 while maintaining the drawer 24 in a horizontally level position when closed.

What is claimed is:

1. A mail sortation and transportation system, comprising:

a mail sorter comprising an output pocket, wherein the mail sorter is configured to receive mail product and to sort at least a portion of the mail product into the output pocket; and a drawer system that is separate from the mail sorter and disposed across an aisle space from the mail sorter, the drawer system comprising a storage rack and a drawer that is slidably coupled to the storage rack;

wherein the drawer comprises a slide mechanism interfacing with the storage rack, wherein the drawer is moveable between a closed position and an open position relative to the storage rack via the slide mechanism;

wherein the storage rack is in a stationary position with respect to the mail sorter when the drawer is in both the closed and open positions relative to the storage rack;

wherein in the closed position the drawer is housed within and fully supported by the storage rack;

wherein in the open position the drawer remains attached to and fully supported by the storage rack and is extended from the storage rack across the aisle space to a position immediately adjacent the output pocket of the mail sorter;

wherein the mail sorter comprises a plurality of output pockets and is configured to receive mail product and to sort the mail product into at least one of the plurality of output pockets, and wherein the drawer system comprises a plurality of drawers that are slidably coupled to the storage rack, wherein each of the plurality of drawers comprises a slide mechanism interfacing with the storage rack, and wherein each of the plurality of drawers is moveable between a closed position and an open position relative to the storage rack via the corresponding slide mechanism; and wherein the mail sorter comprises a total number of output pockets that is equivalent to a total number of drawers in the drawer system.

2. The mail sortation and transportation system of claim 1, wherein the drawer comprises a leading edge that is in direct contact with a lower edge of the output pocket when the drawer is in the open position.

3. The mail sortation and transportation system of claim 1, wherein the drawer is in flush engagement with the output pocket of the mail sorter when in the open position.

4. The mail sortation and transportation system of claim 1, wherein when the drawer is in the open position, a gap of less than approximately one inch in width is present between an edge of the output pocket and a leading edge of the drawer.

5. The mail sortation and transportation system of claim 1, comprising a receiving container removably disposed in the drawer.

6. The mail sortation and transportation system of claim 5, wherein the drawer is not permanently affixed to the output pocket or to the receiving container.

7. The mail sortation and transportation system of claim 5, wherein the drawer comprises an open back side facing a direction opposite the mail sorter, wherein the open back side enables access to the receiving container located within the drawer when the drawer is in the closed position.

8. The mail sortation and transportation system of claim 5, wherein the drawer comprises rollers interfacing with a lower surface of the receiving container.

9. The mail sortation and transportation system of claim 5, wherein the receiving container comprises an automated bin having an adjustable floor or adjustable sides.

10. The mail sortation and transportation system of claim 9, wherein when the drawer is in the open position, the adjustable floor of the receiving container is tilted relative to a horizontal plane.

11. The mail sortation and transportation system of claim 9, wherein the drawer and the slide mechanism of the drawer are both slanted relative to a horizontal plane.

12. The mail sortation and transportation system of claim 9, wherein the drawer comprises:

a stationary portion that remains level with respect to a horizontal plane when the drawer is in the open position and in the closed position; and a moveable portion that is level with respect to the horizontal plane when the drawer is in the closed position, wherein the moveable portion is tilted downward relative to the horizontal plane when the drawer is in the open position.

13. The mail sortation and transportation system of claim 1, wherein the drawer comprises a customizable handle with an edge that can be brought into alignment with the output pocket.

14. The mail sortation and transportation system of claim 1, comprising a tray storage and movement system configured to transport receiving containers into the drawer, away from the drawer, or onto a tray to feeder path.

15. The mail sortation and transportation system of claim 14, wherein the drawer system comprises a "full container" indicator that, when selected by an operator, signals the tray storage and movement system to remove the receiving container from the drawer.

16. A mail sortation and transportation system, comprising:

a drawer system comprising a storage rack and a plurality of drawers that are slidably coupled to and moveable relative to the storage rack, wherein the storage rack is located in a stationary position, and wherein each of the plurality of drawers comprises a slide mechanism interfacing with the storage rack, wherein each of the plurality of drawers is fully supported by the storage rack and moveable relative to the stationary storage rack between a closed position and an open position via the corresponding slide mechanism;

wherein each one of the plurality of drawers, when in the closed position, is housed within and fully supported by the storage rack;

wherein each one of the plurality of drawers, when in the open position, remains attached to and fully supported by the storage rack and is extended from the storage rack across an aisle space to a position immediately adjacent a corresponding one of a plurality of output pockets of a mail sorter located across the aisle space from the drawer system; and wherein the drawer system comprises a total number of drawers that is equivalent to a total number of output pockets in the mail sorter.

17. The mail sortation and transportation system of claim 16, wherein each of the plurality of drawers is extendable across the aisle space such that the mail product in the corresponding one of the plurality of output pockets can be swept from the output pocket directly to the corresponding one of the plurality of drawers without the mail product falling through a gap between the output pocket and the drawer.

18. The mail sortation and transportation system of claim 1, wherein in the closed position an opening at the top of the drawer is inaccessible to an operator in the aisle space, and wherein in the open position the opening at the top of the drawer is accessible to an operator in the aisle space.

* * * * *